US012111068B2

(12) United States Patent
Nakano et al.

(10) Patent No.: US 12,111,068 B2
(45) Date of Patent: Oct. 8, 2024

(54) REFRIGERATION CYCLE APPARATUS

(71) Applicant: DAIKIN INDUSTRIES, LTD., Osaka (JP)

(72) Inventors: Akihiro Nakano, Osaka (JP); Ken Takahashi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/207,598

(22) Filed: Jun. 8, 2023

(65) Prior Publication Data

US 2023/0314038 A1 Oct. 5, 2023

Related U.S. Application Data

(63) Continuation of application No. PCT/JP2022/003248, filed on Jan. 28, 2022.

(30) Foreign Application Priority Data

Jan. 29, 2021 (JP) ..... 2021-013493

(51) Int. Cl.
*F24F 11/84* (2018.01)
*F24F 1/26* (2011.01)

(52) U.S. Cl.
CPC ..... *F24F 11/84* (2018.01); *F24F 1/26* (2013.01)

(58) Field of Classification Search
CPC .. F25B 13/00; F25B 2700/2106; F25B 40/02; F25B 39/04; F25B 39/028; F25B 2313/0253
See application file for complete search history.

(56) References Cited

U.S. PATENT DOCUMENTS

2016/0047581 A1* 2/2016 Cho ..... F25B 41/37 62/529
2018/0112897 A1* 4/2018 Jindou ..... F25B 13/00
2021/0108842 A1* 4/2021 Nishiyama ..... F25B 47/02

FOREIGN PATENT DOCUMENTS

EP 3 819 555 A1 5/2021
JP 2008-256304 A 10/2008
JP 2009-41829 A 2/2009
(Continued)

OTHER PUBLICATIONS

International Search Report for PCT/JP2022/003248 (PCT/ISA/210) mailed on Mar. 29, 2022.
(Continued)

*Primary Examiner* — Nelson J Nieves
*Assistant Examiner* — Meraj A Shaikh
(74) *Attorney, Agent, or Firm* — Birch, Stewart, Kolasch & Birch, LLP

(57) ABSTRACT

The disclosure prevents a state where a liquid refrigerant is likely to be accumulated in an outdoor heat exchanger upon small load operation at low outdoor temperature during cooling operation. A junction part is disposed between a path and a liquid side inlet-outlet port, and includes a junction flow passage configured to cause a refrigerant flowing from the path to the liquid side inlet-outlet port to join and flow therein. A branching passage has a first end connected to the path, and a second end connected to the junction flow passage. An outdoor heat exchanger is configured to increase, upon decrease in load, a flow rate ratio of a refrigerant flowing to the branching passage to volume of a refrigerant flowing to the path.

4 Claims, 4 Drawing Sheets

(56) References Cited

FOREIGN PATENT DOCUMENTS

| | | | |
|---|---|---|---|
| JP | 2010-276313 | A | 12/2010 |
| JP | 2018-169078 | A | 11/2018 |
| WO | WO 2020/008590 | A1 | 1/2020 |

OTHER PUBLICATIONS

English translation of International Preliminary Report on Patentability and Written Opinion of the International Searching Authority for International Application No. PCT/JP2022/003248, dated Aug. 10, 2023.
Extended European Search Report for corresponding European Application No. 22746019.3, dated Mar. 1, 2024.

* cited by examiner

REFRIGERATION CYCLE APPARATUS

CROSS REFERENCE TO RELATED APPLICATIONS

This application is a Continuation of PCT International Application No. PCT/JP2022/003248, filed on Jan. 28, 2022, which claims priority under 35 U.S.C. § 119(a) to Patent Application No. JP 2021-013493, filed in Japan on Jan. 29, 2021, all of which are hereby expressly incorporated by reference into the present application.

TECHNICAL FIELD

The present disclosure relates to a refrigeration cycle apparatus including a refrigerant circuit configured to achieve a vapor compression refrigeration cycle while an outdoor heat exchanger functions as a condenser.

BACKGROUND ART

There has conventionally been known an air conditioner as a type of a refrigeration cycle apparatus disclosed in Patent Literature 1 (Japanese Laid-Open Patent Publication No. 2009-41829). The air conditioner according to Patent Literature 1 has a small load during low-outdoor temperature cooling operation of executing cooling operation when outdoor air temperature is not quite high. As described in Patent Literature 1, executed during low-outdoor temperature cooling operation is small load operation with a smaller number of revolutions of a compressor in comparison to rated operation, in order to be adapted to the small load.

SUMMARY

A refrigeration cycle apparatus according to one aspect includes a refrigerant circuit provided with an outdoor heat exchanger configured to cause heat exchange between outdoor air and a refrigerant and a compressor configured to discharge a compressed refrigerant, and the refrigerant circuit configured to achieve a vapor compression refrigeration cycle while the outdoor heat exchanger functions as a condenser. The outdoor heat exchanger includes an inlet port, an outlet port, a plurality of heat exchange paths, a junction flow passage, and a branching passage. At the inlet port a refrigerant flows into the outdoor heat exchanger when the outdoor heat exchanger functions as a condenser. At the outlet port a refrigerant flows out of the outdoor heat exchanger when the outdoor heat exchanger functions as a condenser. The plurality of heat exchange paths include a plurality of heat transfer tubes configured to cause the refrigerant flowing in through the inlet port upon heat exchange to be distributed to flow in parallel. The junction flow passage is disposed between the plurality of heat exchange paths and the outlet port, and causes refrigerants flowing from the plurality of heat exchange paths to the outlet port to join and then flow therein. The plurality of heat exchange paths include a first path disposed in a lower portion of the outdoor heat exchanger and a second path disposed above the first path. The junction flow passage causes refrigerants having passed at least the first path and the second path to join and then flow therein. The branching passage has a first end connected to the first path, and a second end connected to the junction flow passage. The outdoor heat exchanger is configured to increase, upon decrease in load, a flow rate ratio of the refrigerant flowing to the branching passage to volume of the refrigerant flowing to the first path.

DESCRIPTION OF EMBODIMENTS

Figure 1:
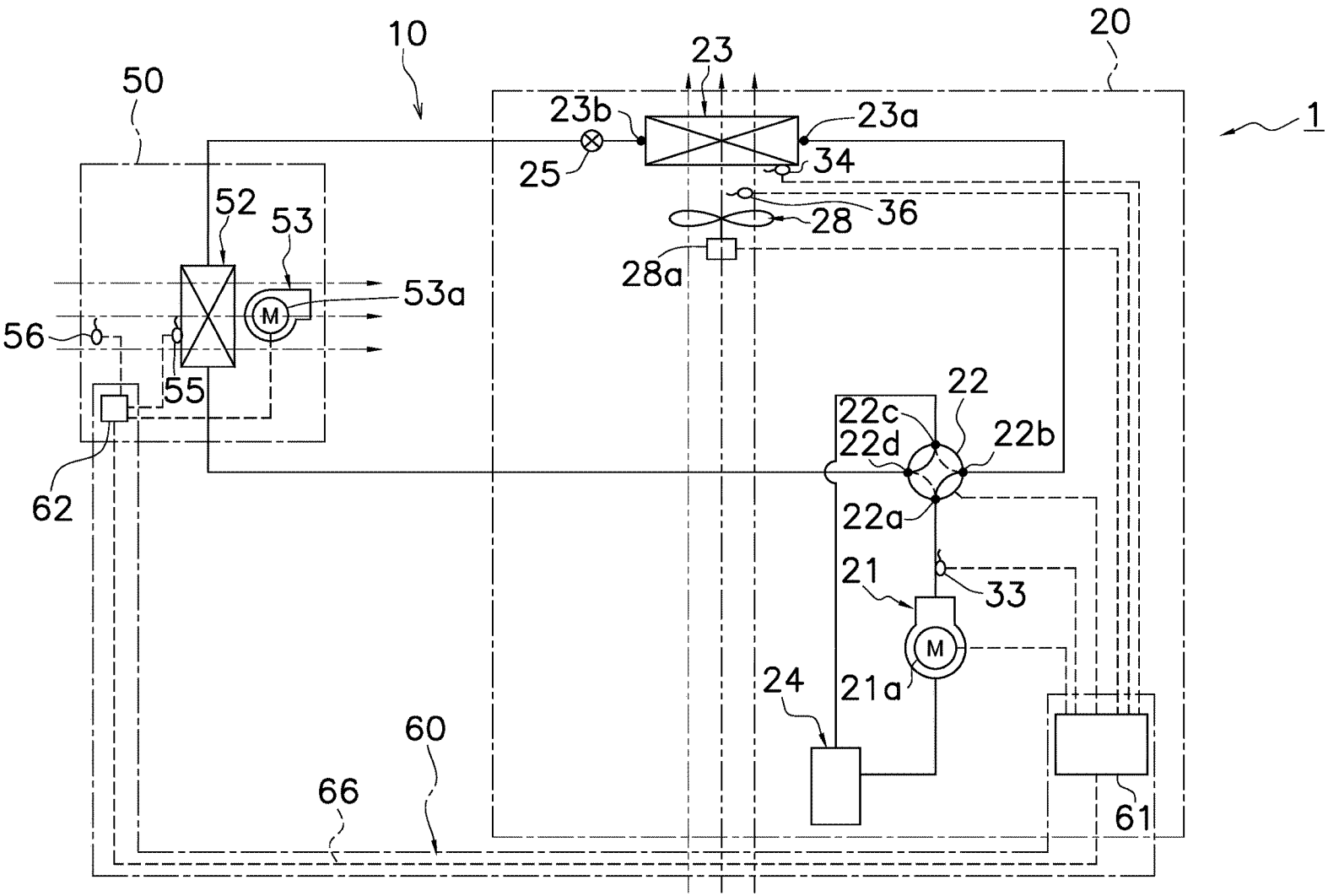
FIG. 1 is a circuit diagram of an air conditioner according to an embodiment.

The description is made to an air conditioner 1 depicted in FIG. 1, which exemplifies a refrigeration cycle apparatus.

(1) Entire Configuration

The air conditioner 1 includes a refrigerant circuit 10. The refrigerant circuit 10 includes a compressor 21, an outdoor heat exchanger 23, an electric expansion valve 25, and an indoor heat exchanger 52. The refrigerant circuit 10 is filled with a refrigerant. Examples of the refrigerant include an R32 refrigerant. The refrigerant in the refrigerant circuit 10 circulates to achieve a vapor compression refrigeration cycle.

The refrigerant circuit 10 in the air conditioner 1 includes a four-way valve 22. The four-way valve 22 switches a circulation direction of the refrigerant circuit 10 to allow the air conditioner 1 to achieve two types of the vapor compression refrigeration cycle. The four-way valve 22 is switched between a first state and a second state to switch the circulation direction of the refrigerant flowing in the refrigerant circuit. In other words, the four-way valve 22 is a flow path switching mechanism configured to switch a flow path in the refrigerant circuit 10 to switch a refrigerant flow direction.

When the four-way valve 22 comes into the first state, the refrigerant discharged from the compressor 21 in the refrigerant circuit 10 flows in the outdoor heat exchanger 23, the electric expansion valve 25, the indoor heat exchanger 52, and the compressor 21 in the mentioned order. When the four-way valve 22 is in the first state, the refrigerant is compressed by the compressor 21, the refrigerant is condensed by the outdoor heat exchanger 23, the refrigerant is decompressed by the electric expansion valve 25, and the refrigerant is evaporated by the indoor heat exchanger 52. In this case, the outdoor heat exchanger 23 functions as a condenser and the indoor heat exchanger 52 functions as an evaporator. In the outdoor heat exchanger 23 functioning as a condenser, the refrigerant is condensed through heat exchange between outdoor air and the refrigerant. In this case, the refrigerant being condensed emits heat to the outdoor air in the outdoor heat exchanger 23. In the indoor heat exchanger 52 functioning as an evaporator, the refrigerant is evaporated through heat exchange between indoor air and the refrigerant. In this case, the refrigerant being evaporated removes heat from the indoor air in the indoor heat exchanger 52. During cooling operation, the four-way valve 22 is switched into the first state and the refrigerant being evaporated removes heat from indoor air to cool the indoor air in the indoor heat exchanger 52.

When the four-way valve 22 comes into the second state, the refrigerant discharged from the compressor 21 in the refrigerant circuit 10 flows in the indoor heat exchanger 52, the electric expansion valve 25, the outdoor heat exchanger 23, and the compressor 21 in the mentioned order. When the four-way valve 22 is in the second state, the refrigerant is compressed by the compressor 21, the refrigerant is condensed by the indoor heat exchanger 52, the refrigerant is decompressed by the electric expansion valve 25, and the refrigerant is evaporated by the outdoor heat exchanger 23. In this case, the outdoor heat exchanger 23 functions as an evaporator and the indoor heat exchanger 52 functions as a condenser. In the outdoor heat exchanger 23 functioning as an evaporator, the refrigerant is evaporated through heat exchange between outdoor air and the refrigerant. In this case, the refrigerant being evaporated removes heat from the outdoor air in the outdoor heat exchanger 23. In the indoor heat exchanger 52 functioning as a condenser, the refrigerant is condensed through heat exchange between indoor air and the refrigerant. In this case, the refrigerant being condensed emits heat to the indoor air in the indoor heat exchanger 52. During heating operation, the four-way valve 22 is switched into the second state, and the refrigerant being condensed in the indoor heat exchanger 52 emits heat to the indoor air to warm the indoor air.

The air conditioner 1 includes an outdoor fan 28 configured to generate a flow of outdoor air passing the outdoor heat exchanger 23, and an indoor fan 53 configured to generate a flow of indoor air passing the indoor heat exchanger 52. FIG. 1 includes arrows of two-dot chain lines indicating airflows generated by the outdoor fan 28 and the indoor fan 53. Each of the outdoor fan 28 and the indoor fan 53 has a variable number of revolutions of its fan. The outdoor fan 28 and the indoor fan 53 each have a varied number of revolutions to vary airflow volume of outdoor air passing the outdoor heat exchanger 23 and airflow volume of indoor air passing the indoor heat exchanger 52.

The refrigeration cycle of the refrigerant circuit 10 described above is controlled by a control unit 60. The control unit 60 accordingly controls an operating frequency of the compressor 21 in accordance with a load. The control unit 60 controls an opening degree of the electric expansion valve 25. The control unit 60 controls the number of revolutions of each of the outdoor fan 28 and the indoor fan 53. The control unit 60 is connected to various sensors provided in the air conditioner 1 to monitor a state of the refrigerant circuit 10. As depicted in FIG. 1, the control unit 60 includes an outdoor unit control unit 61 and an indoor unit control unit 62 connected by means of a transmission line 66.

(2) Detailed Configurations

(2-1) Outdoor Unit

An outdoor unit 20 is disposed in a space in which outdoor air outside an air conditioning target space flows. The outdoor unit 20 is disposed on a roof or a balcony of a building equipped with the air conditioner 1, a site adjacent to the building, or the like.

The outdoor unit 20 accommodates the compressor 21, the four-way valve 22, the outdoor heat exchanger 23, the electric expansion valve 25, an accumulator 24, the outdoor fan 28, and the outdoor unit control unit 61 (see FIG. 1). The outdoor unit 20 accommodates various sensors such as an outdoor heat exchanger temperature sensor 34.

The four-way valve 22 accommodated in the outdoor unit 20 includes a first port 22*a*, a second port 22*b*, a third port 22*c*, and a fourth port 22*d*. In the four-way valve 22 in the first state, the first port 22*a* and the second port 22*b* communicate with each other, and the third port 22*c* and the fourth port 22*d* communicate with each other. In the four-way valve 22 in the second state, the first port 22*a* and the fourth port 22*d* communicate with each other, and the second port 22*b* and the third port 22*c* communicate with each other.

The first port 22*a* of the four-way valve 22 communicates with a discharge port of the compressor 21. The second port 22*b* of the four-way valve communicates with a gas side inlet-outlet port 23*a* of the outdoor heat exchanger 23, and a liquid side inlet-outlet port 23*b* of the outdoor heat exchanger 23 communicates with a first end of the electric expansion valve 25. The third port 22*c* of the four-way valve 22 communicates with a suction port of the compressor 21 via the accumulator 24.

The compressor 21 is configured to suck a low-pressure refrigerant through the suction port, compress the refrigerant in the compressor, and discharge a high-pressure refrigerant obtained by compression through the discharge port. The air conditioner 1 includes the single compressor 21 accommodated in the outdoor unit 20. The compressor 21 included in the air conditioner 1 is not limited to one, and the air conditioner 1 may alternatively include a plurality of compressors. The compressor 21 is a positive displacement compressor and is driven by a motor 21*a*. The motor 21*a* has an operating frequency that can be controlled by an inverter or the like. Control of the operating frequency of the motor 21*a* leads to control of capacity of the compressor 21. Accordingly, increase in operating frequency of the motor 21*a* leads to increase in flow rate of the refrigerant flowing in the refrigerant circuit 10.

The electric expansion valve 25 is configured to be change in opening degree to regulate pressure and the flow rate of the refrigerant flowing in the refrigerant circuit 10. Increase in opening degree of the electric expansion valve 25 leads to increase in difference between pressure of the refrigerant flowing into the electric expansion valve 25 and pressure of the refrigerant flowing out, and decrease in flow rate of the refrigerant flowing in the refrigerant circuit 10.

The accumulator 24 is connected to the suction port of the compressor 21 (see FIG. 1). The accumulator 24 is a vessel having a function of storing an excessive refrigerant generated due to operation load variation of an indoor unit 50 or the like. The accumulator 24 has a gas-liquid separation function of separating an incoming refrigerant into a gas refrigerant and a liquid refrigerant. The refrigerant flowing into the accumulator 24 is separated into a gas refrigerant and a liquid refrigerant, and the gas refrigerant collecting in an upper space flows out to the compressor 21. The refrigerant circuit 10 may alternatively include a receiver having a function of storing an excessive refrigerant, in place of or along with the accumulator 24.

The outdoor fan 28 is configured to supply the outdoor heat exchanger 23 with outdoor air. Specifically, the outdoor fan 28 is configured to suck outdoor air into a casing (not depicted) of the outdoor unit 20, cause the outdoor air to pass the outdoor heat exchanger 23, and exhaust air having exchanged heat with the refrigerant in the outdoor heat exchanger 23 to outside the casing of the outdoor unit 20. The outdoor fan 28 is driven by a motor 28*a* having a variable number of revolutions. Accordingly, increase in number of revolutions of the motor 28*a* of the outdoor fan 28 leads to increase in volume of airflow passing the outdoor heat exchanger 23.

The outdoor unit 20 includes various sensors. The sensors provided in the outdoor unit 20 include a discharge temperature sensor 33, the outdoor heat exchanger temperature sensor 34, and an outdoor temperature sensor 36 (see FIG. 1). The discharge temperature sensor 33 measures discharge temperature Td as temperature of the refrigerant discharged from the compressor 21.

The outdoor heat exchanger temperature sensor 34 is provided at the outdoor heat exchanger 23 (see FIG. 1). The outdoor heat exchanger temperature sensor 34 measures temperature of the refrigerant flowing in the outdoor heat exchanger 23. The outdoor heat exchanger temperature sensor 34 measures refrigerant temperature corresponding to condensation temperature Tc when the outdoor heat exchanger 23 functions as a condenser, and measures refrigerant temperature corresponding to evaporation temperature Te when the outdoor heat exchanger 23 functions as an evaporator. The outdoor temperature sensor 36 measures outdoor air temperature To. The outdoor temperature sensor 36 exemplarily measures temperature of outdoor air sucked into the outdoor unit 20 by the outdoor fan 28 and not yet having exchanged heat in the outdoor heat exchanger 23.

The outdoor unit control unit 61 is embodied by a computer or the like. The outdoor unit control unit 61 exemplarily includes a control arithmetic device and a storage device. Examples of the control arithmetic device can include a processor such as a CPU. The control arithmetic device executes arithmetic processing of reading a program stored in the storage device. The control arithmetic device is further configured to write an arithmetic result to the storage device, and read information stored in the storage device, in accordance with the program.

The outdoor unit control unit 61 is electrically connected to the compressor 21, the four-way valve 22, the electric expansion valve 25, the outdoor fan 28, the discharge temperature sensor 33, the outdoor heat exchanger temperature sensor 34, and the outdoor temperature sensor 36 so as to transmit and receive control signals and information (see FIG. 1).

The outdoor unit control unit 61 is connected to the indoor unit control unit 62 of the indoor unit 50 by means of the transmission line 66 so as to transmit and receive control signals and the like. The outdoor unit control unit 61 and the indoor unit control unit 62 cooperate with each other to function as the control unit 60 configured to control behavior of the entire air conditioner 1. The outdoor unit control unit 61 and the indoor unit control unit 62 may not be connected to each other by means of the physical transmission line 66, and may alternatively be wirelessly connected to be communicable each other.

(2-1-1) Outdoor Heat Exchanger 23

Figure 2:
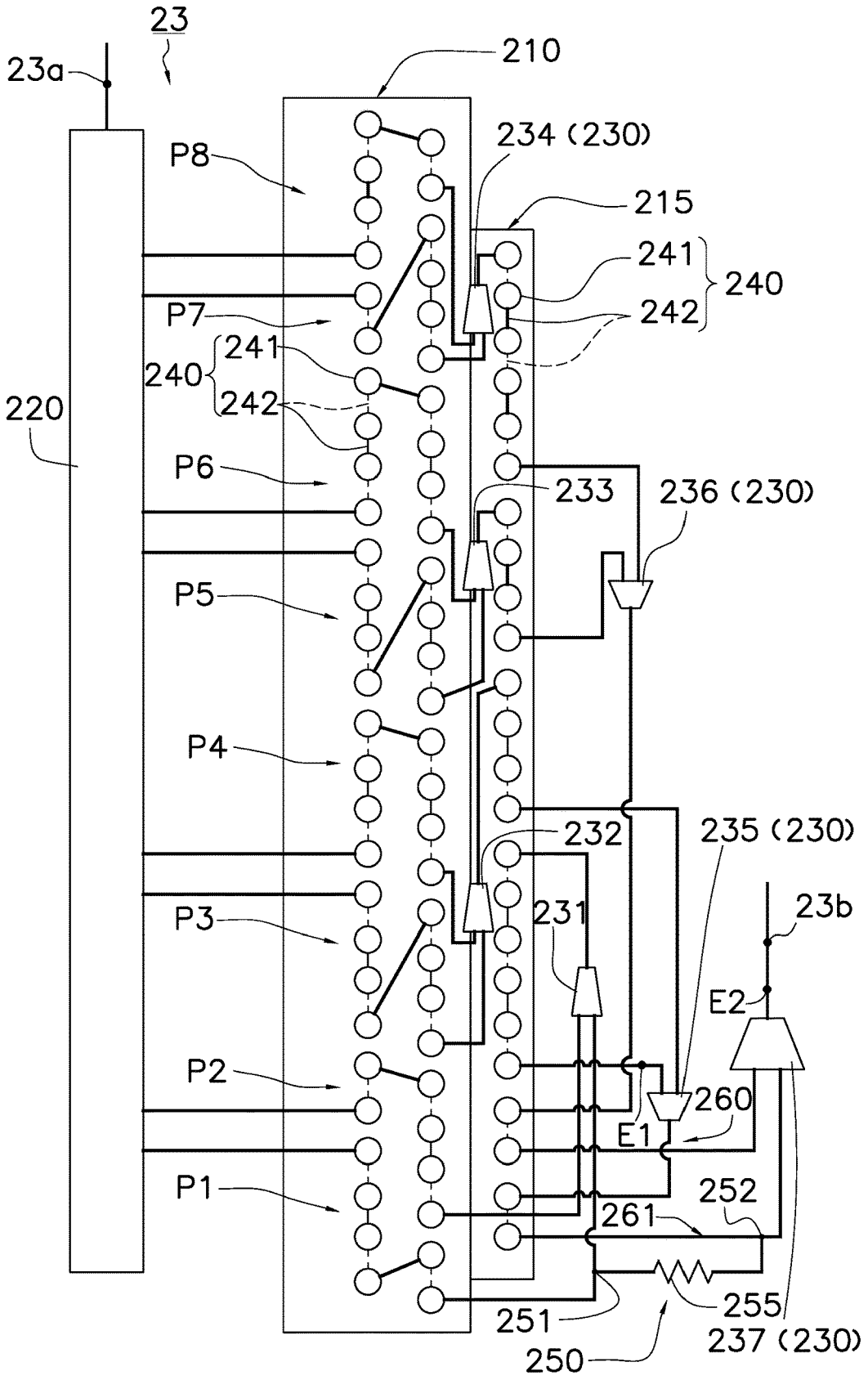
FIG. 2 is a schematic side view depicting an exemplary outdoor heat exchanger.

FIG. 2 schematically depicts a configuration of the outdoor heat exchanger 23. FIG. 2 is a side view of the outdoor heat exchanger 23. The outdoor heat exchanger 23 includes a body 210, an auxiliary heat exchange unit 215, a header 220, and seven flow dividers 230. The seven flow dividers 230 include a first flow divider 231, a second flow divider 232, a third flow divider 233, a fourth flow divider 234, a fifth flow divider 235, a sixth flow divider 236, and a seventh flow divider 237.

The body 210 and the auxiliary heat exchange unit 215 include a heat transfer tube 240 and heat transfer fins (not depicted). The heat transfer tube 240 includes a plurality of straight tubes 241 extending to penetrate a corresponding plurality of heat transfer fins, and a U tube 242 connecting two straight tubes 241 of the heat transfer tube 240. FIG. 2 depicts the straight tubes 241 indicated by circles, and the U tube 242 indicated by a straight solid line or a straight broken line.

The heat transfer tube 240 shapes a plurality of paths P1, P2, P3, P4, P5, P6, P7, and P8 in the body 210. The paths P1 to P8 each have heat exchange executed between outdoor air and the refrigerant. A path has connection between a straight tube 241 and a U tube 242 in the body 210. In other words, a path is a continuous flow path between the header 220 and a flow divider 230, and is constituted by the heat transfer tube 240 disposed in the body 210. As depicted in FIG. 2, the path P8 is disposed at an uppermost portion of the body 210 in the outdoor heat exchanger 23. The path P7 is disposed below and adjacent to the path P8. The paths P7 and P8 each communicate with the fourth flow divider 234. When the outdoor heat exchanger 23 functions as a condenser, the refrigerants flowing in the paths P7 and P8 join at the fourth flow divider 234 and flow to the sixth flow divider 236. The refrigerant flowing out of the fourth flow divider 234 passes the heat transfer tube 240 of the auxiliary heat exchange unit 215 and flows to the sixth flow divider 236.

The path P6 is disposed below and adjacent to the path P7. The path P5 is disposed below and adjacent to the path P6. The paths P5 and P6 each communicate with the third flow divider 233. When the outdoor heat exchanger 23 functions as a condenser, the refrigerants flowing in the paths P5 and P6 join at the third flow divider 233 and flow to the sixth flow divider 236. The refrigerant flowing out of the third flow divider 233 passes the heat transfer tube 240 of the auxiliary heat exchange unit 215 and flows to the sixth flow divider 236.

As depicted in FIG. 2, the paths P5 to P8 are positioned above a vertical center of the body 210. When the outdoor heat exchanger 23 functions as a condenser, the refrigerants flowing in the paths P5 to P8 join at the third flow divider 233 and the fourth flow divider 234, then further join at the sixth flow divider 236, and flow to the seventh flow divider 237. The refrigerant flowing out of the sixth flow divider 236 passes the heat transfer tube 240 of the auxiliary heat exchange unit 215 and flows to the seventh flow divider 237.

As depicted in FIG. 2, the path P4 is disposed below and adjacent to the path P5. The path P3 is disposed below and adjacent to the path P4. The paths P3 and P4 each communicate with the second flow divider 232. When the outdoor heat exchanger 23 functions as a condenser, the refrigerants flowing in the paths P3 and P4 join at the second flow divider 232 and flow to the fifth flow divider 235. The refrigerant flowing out of the second flow divider 232 passes the heat transfer tube 240 of the auxiliary heat exchange unit 215 and flows to the fifth flow divider 235.

The path P2 is disposed below and adjacent to the path P3. The path P1 is disposed below and adjacent to the path P2. The paths P1 and P2 each communicate with the first flow divider 231. When the outdoor heat exchanger 23 functions as a condenser, the refrigerants flowing in the paths P1 and P2 join at the first flow divider 231 and flow to the fifth flow divider 235. The refrigerant flowing out of the first flow divider 231 passes the heat transfer tube 240 of the auxiliary heat exchange unit 215 and flows to the fifth flow divider 235. A liquid refrigerant is particularly hard to flow where the refrigerant needs to flow upward from the path P1 disposed at a lower portion of the outdoor heat exchanger 23 in the first flow divider 231.

As depicted in FIG. 2, the paths P1 to P4 are positioned below the vertical center of the body 210. When the outdoor heat exchanger 23 functions as a condenser, the refrigerants flowing in the paths P1 to P4 join at the first flow divider 231 and the second flow divider 232, then further join at the fifth flow divider 235, and flow to the seventh flow divider 237. The refrigerant flowing out of the fifth flow divider 235 passes the heat transfer tube 240 of the auxiliary heat exchange unit 215 and flows to the seventh flow divider 237.

When the outdoor heat exchanger 23 functions as a condenser, the refrigerants flowing in the paths P1 to P8 eventually join at the seventh flow divider 237 and pass the liquid side inlet-outlet port 23*b* to flow out of the outdoor heat exchanger 23.

When the outdoor heat exchanger 23 functions as a condenser, the refrigerant flowing into the header 220 through one flow in-out port communicating with the gas side inlet-outlet port 23*a* is divided into eight flows to flow out toward the eight paths P1 to P8 of the body 210.

The outdoor heat exchanger 23 includes a branching passage 250. The branching passage 250 includes a capillary tube 255. The branching passage 250 has a first end 251 connected to the path P1 as a first path, and a second end 252 connected to a junction flow passage 261.

The junction flow passage 261 is a flow path included in a junction part 260. The junction part 260, the junction flow passage 261 in more detail, is disposed between the paths P1 to P4 as a plurality of heat exchange paths of the outdoor heat exchanger and the liquid side inlet-outlet port 23*b* serving as an outlet port. The junction flow passage 261 causes the refrigerants flowing from the paths P1 to P4 to the liquid side inlet-outlet port 23*b* to join and then flow therein. The junction part 260 is constituted by the first flow divider 231, the second flow divider 232, the fifth flow divider 235, the heat transfer tube 240 connected thereto, and a pipe of the junction flow passage 261.

When the outdoor heat exchanger 23 functions as an evaporator, the refrigerant flows in through the liquid side inlet-outlet port 23*b*. The refrigerant flowing in through the liquid side inlet-outlet port 23*b* is divided by the seventh flow divider 237 into two flow paths, which are divided by the fifth flow divider 235 and the sixth flow divider 236 into four flow paths, which are further divided by the first to fourth flow dividers 231 to 234 into eight flow paths. The eight flow paths thus divided by the first to fourth flow dividers 231 to 234 are connected with the paths P1 to P8. When the outdoor heat exchanger 23 functions as an evaporator, the refrigerants having passed the paths P1 to P8 flow into the header 220 to join, flow from the header 220 to pass the gas side inlet-outlet port 23*a*, and flow out of the outdoor heat exchanger 23.

The outdoor heat exchanger temperature sensor 34 is attached to the U tube 242 disposed halfway on the path P3 or the like. The outdoor heat exchanger temperature sensor 34 is used to detect defrosting completion timing upon defrosting operation of removing frost adhering during heating operation. Frost melts gradually from the top of the outdoor heat exchanger 23 during defrosting operation. The outdoor heat exchanger temperature sensor 34 is thus preferably attached below the outdoor heat exchanger 23. In order for detection of defrosting completion timing, the outdoor heat exchanger temperature sensor 34 is preferably attached to a path disposed at a lower portion of the body 210, such as the path P1, P2, or P3. Particularly in a case where the refrigerant is divided at the header 220 into flows equal in number to the paths, the outdoor heat exchanger temperature sensor 34 may be attached to the lowermost path P1 of the outdoor heat exchanger 23 in view of detection of defrosting completion timing.

(2-2) Indoor Unit

The indoor unit 50 is disposed for the air conditioning target space. Examples of the air conditioning target space include the interior of a room. The indoor unit 50 is of a wall hung type to be attached to a wall in the room, of a ceiling embedded type to be embedded in a ceiling in the room, of a floor-standing type to be placed on a floor in the room, or the like. The indoor unit 50 may be disposed inside or outside the air conditioning target space. The indoor unit 50 may be disposed outside the air conditioning target space, exemplarily in an attic space, a machine chamber, or a garage. When the indoor unit 50 is disposed outside the air conditioning target space, there is disposed an air passage for supply, from the indoor unit 50 to the air conditioning target space, of air having exchanged heat with the refrigerant in the indoor heat exchanger 52. Examples of the air passage include a duct.

The indoor unit 50 accommodates the indoor heat exchanger 52, the indoor fan 53, the indoor unit control unit 62, and various sensors (see FIG. 1). The sensors provided in the indoor unit 50 include an indoor heat exchanger temperature sensor 55 and an indoor temperature sensor 56 (see FIG. 1). The indoor temperature sensor 56 measures indoor air temperature Tr. The indoor temperature sensor 56 exemplarily measures temperature of indoor air sucked into the indoor unit 50 by the indoor fan 53 and not yet having exchanged heat in the indoor heat exchanger 52. The indoor heat exchanger temperature sensor 55 measures temperature of the refrigerant flowing in the indoor heat exchanger 52. The indoor heat exchanger temperature sensor 55 measures refrigerant temperature corresponding to the condensation temperature Tc when the indoor heat exchanger 52 functions as a condenser, and measures refrigerant temperature corresponding to the evaporation temperature Te when the indoor heat exchanger 52 functions as an evaporator.

The indoor heat exchanger 52 causes heat exchange between the refrigerant flowing in the indoor heat exchanger 52 and air in the air conditioning target space (indoor air). The indoor heat exchanger 52 is exemplarily a fin-and-tube heat exchanger including a plurality of heat transfer tubes and a plurality of fins (not depicted). The indoor heat exchanger 52 has a liquid side inlet-outlet port communicating with a second end of the electric expansion valve 25. The indoor heat exchanger 52 has a gas side inlet-outlet port communicating with the fourth port 22*d* of the four-way valve 22.

The indoor fan 53 is configured to supply the indoor heat exchanger 52 with indoor air (air in the air conditioning target space). The indoor fan 53 is driven by a motor 53*a* having a variable number of revolutions. Increase in number of revolutions of the motor 53*a* of the indoor fan 53 leads to increase in volume of airflow passing the indoor heat exchanger 52.

The indoor temperature sensor 56 is provided on an air suction side of a casing (not depicted) of the indoor unit 50. The indoor temperature sensor 56 detects temperature (the indoor air temperature Tr) of air in the air conditioning target space flowing into the casing of the indoor unit 50.

The indoor unit control unit 62 controls behavior of respective parts of the indoor unit 50. The indoor unit control unit 62 is embodied by a computer or the like. The indoor unit control unit 62 exemplarily includes a control arithmetic device and a storage device. Examples of the control arithmetic device can include a processor such as a CPU. The control arithmetic device executes arithmetic processing of reading a program stored in the storage device. The control arithmetic device is further configured to write an arithmetic result to the storage device, and read information stored in the storage device, in accordance with the program.

The indoor unit control unit 62 is electrically connected between the indoor fan 53 and the indoor temperature sensor 56 so as to transmit and receive control signals and information (see FIG. 1).

The indoor unit control unit 62 is configured to receive various signals transmitted from a remote controller (not depicted) provided to operate the indoor unit 50. Examples of the various signals transmitted from the remote controller include a command signal to operate or stop the indoor unit 50, an operating mode switch signal, and a signal relevant to set temperature Trs of indoor air for cooling operation or heating operation.

(2-3) Behavior of Air Conditioner (2-3-1) Behavior During Cooling Operation

When the air conditioner 1 is commanded to execute cooling operation by means of the remote controller or the like, the control unit 60 sets the operating mode of the air conditioner 1 to a cooling operation mode. In the cooling operation mode, the control unit 60 switches the four-way valve 22 on the refrigerant circuit 10 into the first state, and then drives the compressor 21, the outdoor fan 28, and the indoor fan 53.

During cooling operation, the control unit 60 controls the number of revolutions of the motor 53*a* of the indoor fan 53 in accordance with a command inputted to the remote controller, such as a command on airflow volume, or the like. The control unit 60 controls the opening degree of the electric expansion valve 25 in order to suppress, to or less than a predetermined value, a rate of a liquid refrigerant in the refrigerant sucked into the compressor 21. The control unit 60 thus controls such that a difference (Td−Tc) between the discharge temperature Td and the condensation temperature Tc is equal to or more than first predetermined temperature. In other words, the control unit 60 controls the opening degree of the electric expansion valve 25 in accordance with a discharge superheating degree. The outdoor heat exchanger temperature sensor 34 can normally measure temperature (saturation temperature) of a refrigerant in a gas-liquid two-phase state, and the control unit 60 thus adopts a measurement value of the outdoor heat exchanger temperature sensor 34 as the condensation temperature Tc.

The control unit 60 controls the operating frequency of the compressor 21 in accordance with a load. The control unit 60 decreases the operating frequency of the compressor 21 when the air conditioner 1 has a small load. In an exemplary case where a difference (To−Tr) between the outdoor air temperature To and the indoor air temperature Tr and a difference (Tr−Trs) between the indoor air temperature Tr and the set temperature Trs are both small during cooling operation, the air conditioner 1 has a small load and the control unit 60 accordingly decreases the operating frequency of the compressor 21. During normal operation other than small load operation or the like, the operating frequency of the compressor 21 is exemplarily from several tens of Hz to one hundred and several tens of Hz. During small load operation smaller in load than normal operation, the control unit 60 controls the operating frequency of the compressor 21 so as to be less than 10 Hz or the like. The compressor 21 has the lowest operating frequency particularly during predetermined small load operation. The control unit 60 further controls the number of revolutions of the motor 28*a* of the outdoor fan 28 in accordance with the outdoor air temperature To.

During small load operation, the operating frequency of the compressor 21 is small and the refrigerant is thus likely to be accumulated in the outdoor heat exchanger 23. Particularly upon small load operation at low outdoor air temperature during cooling operation, a liquid refrigerant may be accumulated in the heat transfer tube 240 in a lower region of the outdoor heat exchanger 23. If the outdoor heat exchanger temperature sensor 34 is attached to the heat transfer tube 240 in the lower region, the outdoor heat exchanger temperature sensor 34 measures temperature of a refrigerant in a liquid state, failing to measure temperature (saturation temperature) of the refrigerant in the gas-liquid two-phase state. In such a case, the control unit 60 cannot adopt, as the condensation temperature Tc, the measurement value of the outdoor heat exchanger temperature sensor 34, upon control of the refrigeration cycle of the refrigerant circuit 10.

If the outdoor heat exchanger 23 has large volume of a liquid refrigerant accumulated during small load operation, the refrigerant circuit 10 has circulation of an insufficient refrigerant.

In order to prevent defects mentioned above, the outdoor heat exchanger 23 is provided with the branching passage 250 such that a liquid refrigerant is unlikely to be accumulated in the outdoor heat exchanger 23. The outdoor heat exchanger 23 is configured to increase, upon decrease in load, a flow rate ratio of the refrigerant flowing to the branching passage 250 to volume of the refrigerant flowing to the lowermost path P1 (first path) of the body 210.

During rated operation (during large load operation), the ratio of volume of the refrigerant flowing in the branching passage to volume of the refrigerant flowing from the path P1 (first path) to the junction flow passage 261 without passing the branching passage 250 is 1/14 or the like. In contrast, during small load operation, the ratio of volume of the refrigerant flowing in the branching passage to volume of the refrigerant flowing from the path P1 (first path) to the junction flow passage 261 without passing the branching passage 250 is less than 1/1 or the like. In this manner, the flow rate ratio of the refrigerant flowing to the branching passage 250 to volume of the refrigerant flowing from the path P1 (first path) to the junction flow passage 261 without passing the branching passage 250 during predetermined small load operation is preferably five times or more the flow rate ratio during rated operation. During predetermined small load operation, the compressor in the air conditioner 1 has the lowest operating frequency. The operating frequency of the compressor is 6 Hz or the like during predetermined small load operation.

When the refrigerant flowing to the refrigerant circuit 10 is an R32 refrigerant, a ratio (PL2/PL1) of pressure loss PL2 from the first end 251 to the second end 252 of the branching passage 250 to pressure loss PL1 from the path P1 (first path) to the second end 252 of the branching passage 250 via the junction part 260 is preferably less than one during predetermined small load operation.

(2-3-2) Behavior During Heating Operation

When the air conditioner 1 is commanded to execute heating operation by means of the remote controller or the like, the control unit 60 sets the operating mode of the air conditioner 1 to a heating operation mode. In the heating operation mode, the control unit 60 switches the four-way valve 22 on the refrigerant circuit 10 into the second state, and then drives the compressor 21, the outdoor fan 28, and the indoor fan 53.

During heating operation, the control unit 60 controls the number of revolutions of the motor 53*a* of the indoor fan 53 in accordance with a command inputted to the remote controller, such as a command on airflow volume, or the like. The control unit 60 controls the refrigeration cycle assuming that refrigerant temperature measured by the indoor heat exchanger temperature sensor 55 is the condensation temperature Tc. The control unit 60 controls the opening degree of the electric expansion valve 25 in order to suppress the rate of a liquid refrigerant in the refrigerant sucked into the compressor 21. The control unit 60 thus controls such that the difference (Td−Tc) between the discharge temperature Td and the condensation temperature Tc is equal to or more than the first predetermined temperature.

The control unit 60 controls the operating frequency of the compressor 21 in accordance with a load. The control unit 60 decreases the operating frequency of the compressor 21 when the air conditioner 1 has a small load. In an exemplary case where the difference (To−Tr) between the outdoor air temperature To and the indoor air temperature Tr and a difference (To−Trs) between the outdoor air temperature To and the set temperature Trs are both small during cooling operation, the air conditioner 1 has a small load and the control unit 60 accordingly decreases the operating frequency of the compressor 21. The control unit 60 further controls the number of revolutions of the motor 28*a* of the outdoor fan 28 in accordance with the outdoor air temperature To.

The control unit 60 executes defrosting operation in order to remove frost adhering to the outdoor heat exchanger 23 during heating operation. Defrosting is achieved when the outdoor heat exchanger 23 functions as a condenser as in cooling operation, through operation (called reverse cycle defrosting operation) of melting frost with use of a high-temperature refrigerant supplied to the outdoor heat exchanger 23. A defrosting method is not limited to the reverse cycle defrosting operation, and defrosting may alternatively be executed in accordance with a different method.

(3) Modification Examples

(3-1) Modification Example A

The embodiment described above refers to the case where the refrigeration cycle apparatus is the air conditioner 1. However, the refrigeration cycle apparatus should not be limited to the air conditioner 1. Examples of the refrigeration cycle apparatus include a refrigerator, a freezer, a hot water supplier, and a floor heater.

(3-2) Modification Example B

The junction part 260 according to the above embodiment includes the junction flow passage 261 configured to cause the refrigerants flowing from the paths P1 to P4 to the liquid side inlet-outlet port 23*b* to join and flow therein, and is constituted by the first flow divider 231, the second flow divider 232, and the fifth flow divider 235, the heat transfer tube 240 of the auxiliary heat exchange unit 215 connected thereto, and the pipe of the junction flow passage 261. However, the junction part 260 is not limited to the above in terms of its configuration. For example, the second end 252 of the branching passage 250 may be connected to a point E1 indicated in FIG. 2. In this case, the junction part incudes a junction flow passage (a flow path at the point E1) configured to cause the refrigerants flowing from the paths P1 and P2 to the liquid side inlet-outlet port 23*b* to join and flow therein. The junction part in this case is constituted by the first flow divider 231, the heat transfer tube 240 of the auxiliary heat exchange unit 215 connected thereto, and the pipe of the junction flow passage.

Furthermore, the second end 252 of the branching passage 250 may be connected to a point E2 indicated in FIG. 2. In this case, the junction part incudes a junction flow passage (a flow path at the point E2) configured to cause the refrigerants flowing from the paths P1 to P8 to the liquid side inlet-outlet port 23*b* to join and flow therein. The junction part in this case is constituted by the first to seventh flow dividers 231 to 237, the heat transfer tube 240 of the auxiliary heat exchange unit 215 connected thereto, and the pipe of the junction flow passage.

(3-3) Modification Example C

The above embodiment refers to the outdoor heat exchanger 23 divided into the body 210 and the auxiliary heat exchange unit 215. The outdoor heat exchanger 23 may alternatively be constituted only by the body 210 without including the auxiliary heat exchange unit 215. Furthermore, in the body 210 according to the above embodiment includes the heat transfer tubes 240 (straight tubes 241) arranged in two rows in an outdoor air passing direction. The heat transfer tubes in the body are not limitedly arranged in the two rows, and may alternatively be arranged in a single row, or three or more rows. The above embodiment refers to the case where the body 210 is provided with the eight paths P1 to P8. The outdoor heat exchanger 23 should not be limited to eight in terms of its number of the paths.

(3-4) Modification Example D

Figure 3:
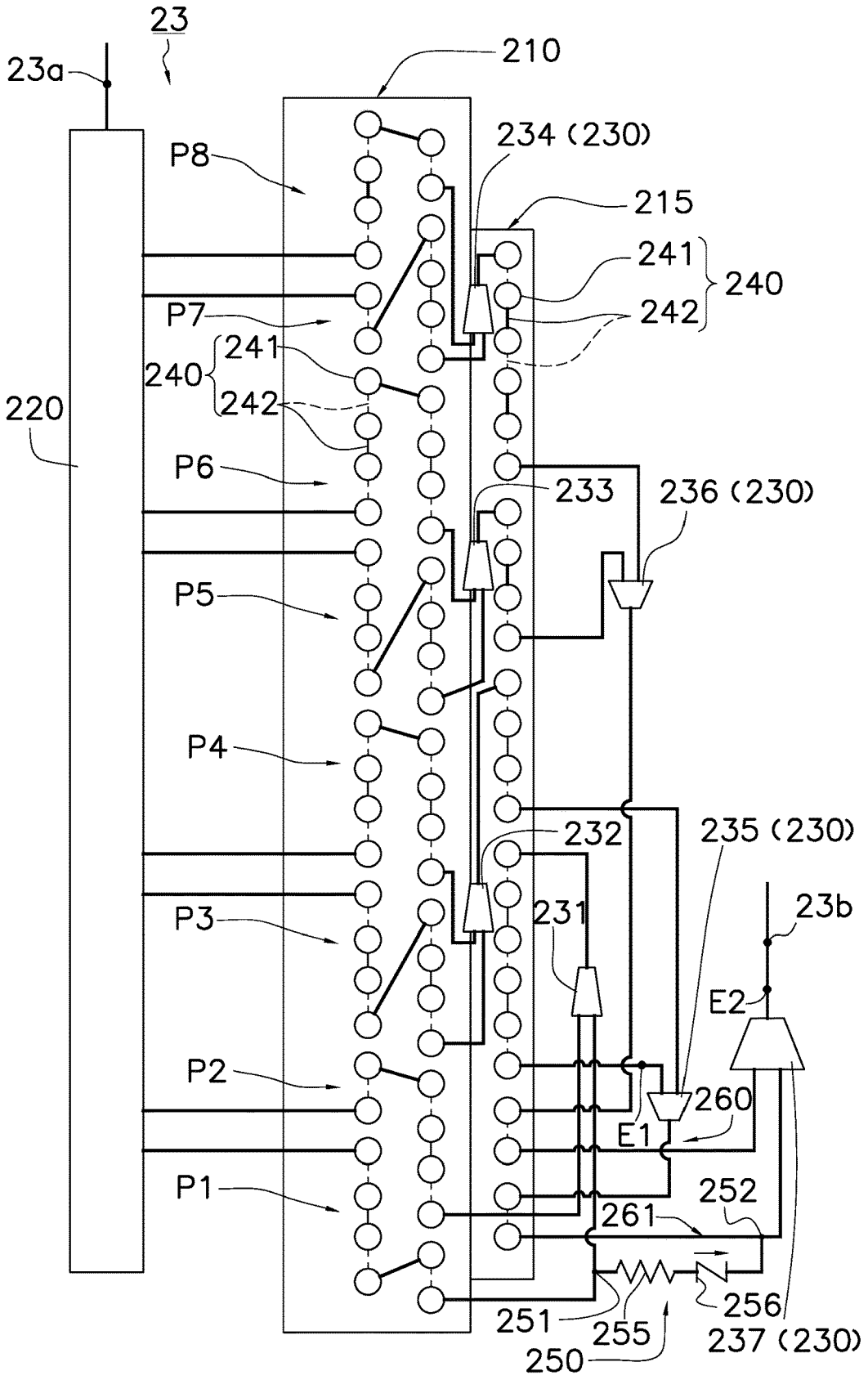
FIG. 3 is a schematic side view depicting another exemplary outdoor heat exchanger.

The above embodiment refers to the case where the branching passage 250 is provided only with the capillary tube 255. As depicted in FIG. 3, the branching passage 250 may alternatively be provided with a check valve 256 in addition to the capillary tube 255. The check valve 256 provided at the branching passage 250 is attached so as to allow a flow of a refrigerant from the path P1 toward the liquid side inlet-outlet port 23*b* and prevent a reverse flow of a refrigerant from the liquid side inlet-outlet port 23*b* toward the path P1. In this case, the capillary tube 255 and the check valve 256 are connected in series between the first end 251 and the second end 252 of the branching passage 250. Due to the check valve 256, the refrigerant is unlikely to flow to the branching passage 250 when the outdoor heat exchanger 23 functions as an evaporator, to inhibit deterioration in heat exchange efficiency because the auxiliary heat exchange unit 215 has no refrigerant flow.

(3-5) Modification Example E

Figure 4:
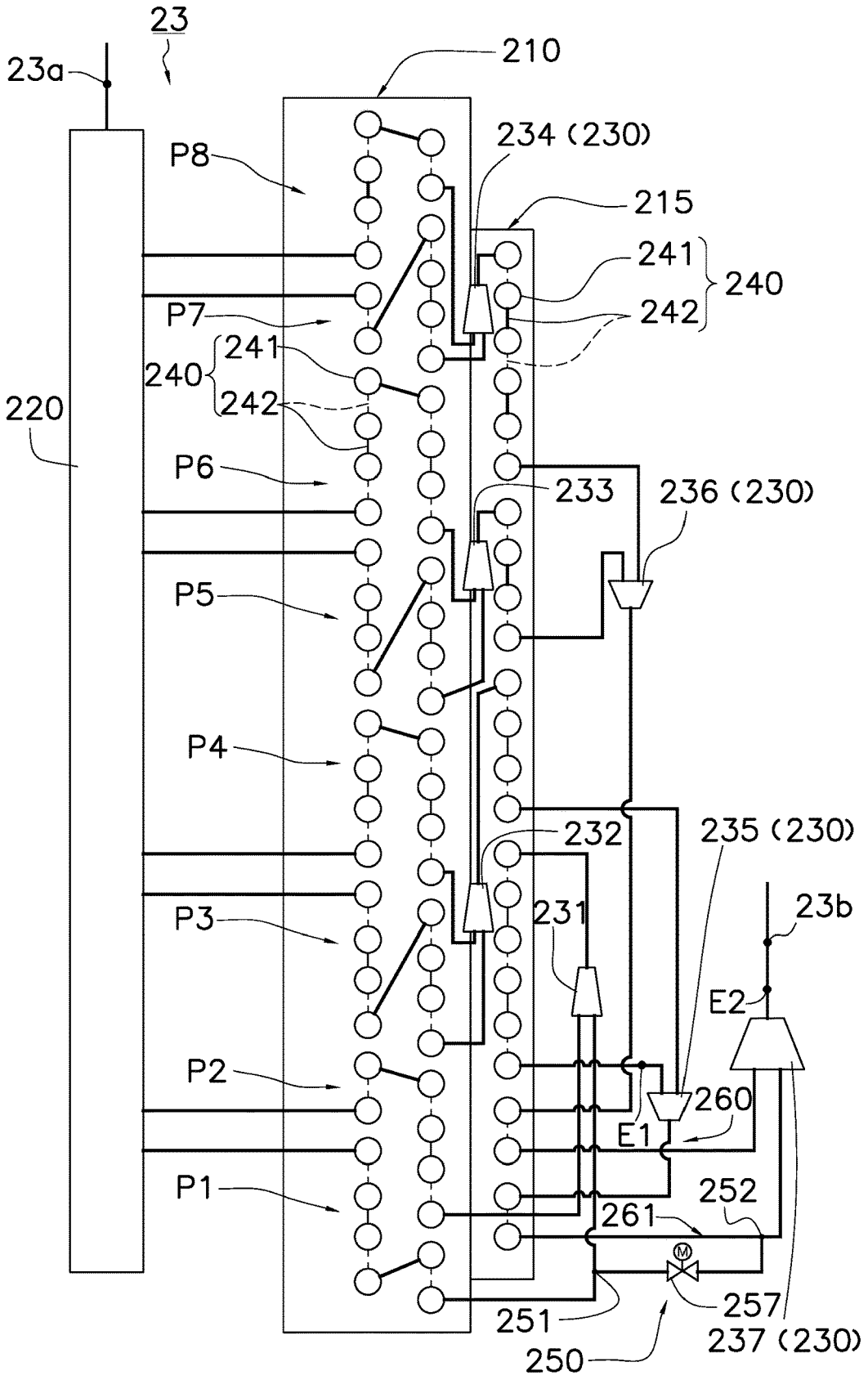
FIG. 4 is a schematic side view depicting still another exemplary outdoor heat exchanger.

The above embodiment refers to the case where the branching passage 250 includes the capillary tube 255. As depicted in FIG. 4, the branching passage 250 may alternatively include a motor valve 257 having a variable opening degree, in place of the capillary tube 255. In the case where the branching passage 250 includes the motor valve 257, the outdoor unit control unit 61 in the control unit 60 controls the opening degree of the motor valve 257. When the outdoor heat exchanger 23 functions as a condenser, the outdoor unit control unit 61 in the control unit 60 controls to increase the opening degree of the motor valve 257 as the load decreases. The control unit 60 maximizes the opening degree of the motor valve 257 during predetermined small load operation, in other words, when the load is minimized. When the opening degree of the motor valve 257 is controlled to increase as the load decreases, a liquid refrigerant is likely to flow through the branching passage 250 as the load decreases. This can inhibit accumulation of a liquid refrigerant in the outdoor heat exchanger 23 during small load operation. The control unit 60 controls the motor valve 257 to have the minimum opening degree when the outdoor heat exchanger 23 functions as an evaporator. Accordingly, the refrigerant is unlikely to flow to the branching passage 250 when the outdoor heat exchanger 23 functions as an evaporator, to inhibit deterioration in heat exchange efficiency because of no refrigerant flow in the auxiliary heat exchange unit 215 when the outdoor heat exchanger 23 functions as an evaporator.

(3-6) Modification Example F The above embodiment refers to the air conditioner 1 configured to cool (inclusive of dehumidifying) and heat the air conditioning target space. The air conditioner may alternatively be configured to execute only cooling operation.

(4) Characteristics 4-1

When the outdoor heat exchanger 23 functions as a condenser, the air conditioner 1 described above can decrease volume of the refrigerant flowing to the branching passage 250 to inhibit deterioration in performance when the air conditioner 1 has a large load, and can cause large volume of the refrigerant to flow to the branching passage 250 to inhibit accumulation of a liquid refrigerant in the path P1 during small load operation with a small load. In the above embodiment, the path P1 corresponds to the first path and the path P2 corresponds to the second path. The junction flow passage 261 causes the refrigerants having passed at least the path P1 (first path) and the path P2 (second path) to join and then flow therein. The outdoor heat exchanger 23 can inhibit accumulation of a liquid refrigerant therein during small load operation where the outdoor heat exchanger 23 functions as a condenser, to inhibit shortage of the refrigerant for achievement of an appropriate refrigeration cycle. It is also possible to prevent failing in measuring the condensation temperature Tc because the portion of the heat transfer tube 240 provided with the outdoor heat exchanger temperature sensor 34 is immersed in a liquid refrigerant. When the outdoor heat exchanger 23 functions as a condenser, the gas side inlet-outlet port 23*a* serves as a refrigerant inlet port, and the liquid side inlet-outlet port 23*b* serves as a refrigerant outlet port.

4-2

The air conditioner 1 described above is configured to increase, upon decrease in load, the flow rate ratio of the refrigerant flowing to the branching passage 250 to volume of the refrigerant flowing to the path P1 (first path), with use of the capillary tube 255 without complicated control. The air conditioner 1 can thus inhibit accumulation of a liquid refrigerant in the outdoor heat exchanger 23 at low cost.

4-3

In the air conditioner 1, the flow rate ratio of the refrigerant flowing to the branching passage 250 to volume of the refrigerant flowing from the path P1 (first path) to the junction flow passage 261 without passing the branching passage 250 during predetermined small load operation is five times or more the flow rate ratio during rated operation, to achieve a sufficient flow of a liquid refrigerant during predetermined small load operation. During predetermined small load operation, the compressor 21 has the lowest operating frequency in this case.

4-4

In the air conditioner 1, the ratio of pressure loss from the first end 251 to the second end 252 of the branching passage to pressure loss from the path P1 (first path) to the second end via the junction part 260, the junction flow passage 261 in more detail, is set to be less than one during predetermined small load operation, to achieve a sufficient flow of a liquid refrigerant during load operation.

4-5

The air conditioner 1 according to the modification example E is configured to increase, upon decrease in load, the flow rate ratio of the refrigerant flowing to the branching passage 250 to volume of the refrigerant flowing to the path P1 (first path), easily with use of the control unit 60 and the motor valve 257. For example, the control unit 60 finds increase and decrease in load and commands the operating frequency of the compressor 21, and thus increases or decreases volume of the refrigerant flowing to the branching passage 250 in accordance with the load with reference to information kept by the control unit 60 itself.

4-6

In the air conditioner 1 according to the modification example E, the motor valve 257 is controlled to be decreased in opening degree as a load increases when the outdoor heat exchanger 23 functions as a condenser, for improvement in performance of the air conditioner 1. Furthermore, the motor valve 257 is controlled to have the minimum opening degree when the outdoor heat exchanger 23 functions as an evaporator, for inhibition of deterioration in performance of the refrigeration cycle apparatus due to provision of the branching passage 250.

The embodiments of the present disclosure have been described above. Various modifications to modes and details should be available without departing from the object and the scope of the present disclosure recited in the claims.

REFERENCE SIGNS LIST

1: air conditioner (exemplifying refrigeration cycle apparatus)
10: refrigerant circuit
21: compressor
23: outdoor heat exchanger
23*a*: gas side inlet-outlet port (exemplifying an inlet port when outdoor heat exchanger 23 functions as condenser)
23*b*: liquid side inlet-outlet port (exemplifying an outlet port when outdoor heat exchanger 23 functions as condenser)
60: control unit
240: heat transfer tube
250: branching passage
251: first end of branching passage

252: second end of branching passage
255: capillary tube
257: motor valve
260: junction part
261: junction flow passage
P1: path (exemplifying heat exchange path, exemplifying first path)
P2: path (exemplifying heat exchange path, exemplifying second path)
P3 to P8: path (exemplifying heat exchange path)

CITATION LIST

Patent Literature

Patent Literature 1: Japanese Laid-Open Patent Publication No. 2009-41829

The invention claimed is:

1. A refrigeration cycle apparatus comprising a refrigerant circuit including an outdoor heat exchanger configured to cause heat exchange between outdoor air and a refrigerant, and a controller configured to control an operating frequency of a compressor configured to discharge a compressed refrigerant, the refrigerant circuit configured to achieve a vapor compression refrigeration cycle while the outdoor heat exchanger functions as a condenser, wherein the outdoor heat exchanger includes an inlet port where a refrigerant flows into the outdoor heat exchanger when the outdoor heat exchanger functions as a condenser, an outlet port where a refrigerant flows out the outdoor heat exchanger when the outdoor heat exchanger functions as a condenser, a plurality of heat exchange paths including a plurality of heat transfer tubes configured to cause the refrigerant flowing in through the inlet port upon the heat exchange to be distributed and flow in parallel, a junction flow passage disposed between the plurality of heat exchange paths and the outlet port and configured to cause refrigerant flowing from the plurality of heat exchange paths to the outlet port to join and then flow therein, and a branching passage, the plurality of heat exchange paths includes a first path disposed in a lower portion of the outdoor heat exchanger, and a second path disposed above the first path, the junction flow passage is configured to cause refrigerant having passed at least the first path and the second path to join and then flow therein, the branching passage includes a capillary tube, and has a first end connected to the first path and a second end connected to the junction flow passage, the first end of the branching passage is connected to a portion on the outlet port side of the heat transfer tube in the first path, the plurality of heat transfer tubes of the plurality of heat exchange paths penetrates through a corresponding plurality of heat transfer fins, and the controller, in response to a decrease in load of the air conditioning apparatus, is configured to increase a flow rate ratio of the refrigerant flowing to the branching passage to volume of the refrigerant flowing to the first path at the outdoor heat exchanger, by using the capillary tube and by controlling the operating frequency of the compressor.

2. The refrigeration cycle apparatus according to claim 1, wherein the flow rate ratio of volume of the refrigerant flowing to the branching passage to volume of the refrigerant flowing from the first path without passing the branching passage during predetermined small load operation is five times or more in comparison to the flow rate ratio during rated operation.

3. The refrigeration cycle apparatus according to claim 1, wherein the refrigerant flowing to the refrigerant circuit is an R32 refrigerant, and a ratio of pressure loss from the first end to the second end of the branching passage to pressure loss from the first path to the second end via the junction flow passage is less than one during predetermined small load operation.

4. The refrigeration cycle apparatus according to claim 2, wherein the refrigerant flowing to the refrigerant circuit is an R32 refrigerant, and a ratio of pressure loss from the first end to the second end of the branching passage to pressure loss from the first path to the second end via the junction flow passage is less than one during predetermined small load operation.

* * * * *